US008943986B2

(12) United States Patent
Mauer

(10) Patent No.: US 8,943,986 B2
(45) Date of Patent: Feb. 3, 2015

(54) RETRACTABLE STABILIZER FOR WATERCRAFT

(76) Inventor: Brian Mauer, Denver, IA (US)

( * ) Notice: Subject to any disclaimer, the term of this patent is extended or adjusted under 35 U.S.C. 154(b) by 0 days.

(21) Appl. No.: 13/156,279

(22) Filed: Jun. 8, 2011

(65) Prior Publication Data

US 2012/0216739 A1 Aug. 30, 2012

Related U.S. Application Data

(60) Provisional application No. 61/393,168, filed on Oct. 14, 2010.

(51) Int. Cl.
*B63B 43/00* (2006.01)
*B63B 43/14* (2006.01)
*B63B 35/71* (2006.01)

(52) U.S. Cl.
CPC ..... *B63B 43/14* (2013.01)
USPC ..... 114/123; 114/347; 114/364

(58) Field of Classification Search
CPC ..... B63B 35/71; B63B 39/06; B63B 39/062; B63B 43/00; B63B 43/14; B63B 2035/715; B63B 2739/00
USPC ..... 114/123, 347, 121, 283, 343, 364
See application file for complete search history.

(56) References Cited

U.S. PATENT DOCUMENTS

| | | | | |
|---|---|---|---|---|
| 2,794,191 | A * | 6/1957 | Gaskouitz | 114/364 |
| 3,929,085 | A * | 12/1975 | Mason | 114/123 |
| 6,305,306 | B1 * | 10/2001 | Grzybowski | 114/123 |
| D457,121 | S * | 5/2002 | Gyzybowski | D12/317 |
| 7,644,674 | B1 * | 1/2010 | Goldston | 114/123 |
| 7,650,847 | B1 * | 1/2010 | Wicks et al. | 114/123 |
| 7,789,035 | B1 * | 9/2010 | Rosenberg et al. | 114/363 |
| 2002/0069808 | A1 | 6/2002 | Hesse | |
| 2006/0102063 | A1 | 5/2006 | Boelryk | |
| 2007/0068436 | A1 | 3/2007 | Page | |
| 2009/0090290 | A1 * | 4/2009 | Mueller | 114/360 |

* cited by examiner

*Primary Examiner* — Ajay Vasudeva
(74) *Attorney, Agent, or Firm* — Schmeiser, Olsen & Watts, LLP

(57) ABSTRACT

A user floatation system for boating safety. There is included in the system a boat, having a seat for a user, and a rear and forward section located behind and in front of the user respectively. There is also a flotation system, including float device, designed to be placed in the water on at least one side of the boat; and frame system, coupled to the boat at one end and to the float device at an opposite end, designed to hold the float device in a 1) deployed position where the float device is held in the water when a user is in the seat, and 2) partially deployed position where the float device is held a distance above the water level when a user is in the seat sufficient to enable the user to tip the boat a certain angle from a level position but to assist in preventing the boat from tipping completely over.

1 Claim, 11 Drawing Sheets

RETRACTABLE STABILIZER FOR WATERCRAFT

CROSS-REFERENCE TO RELATED APPLICATIONS

This invention claims of priority, under 35 U.S.C. §120, to U.S. Provisional Patent Application No. 61/393,168, which is incorporated by reference herein. This invention claims no priority, under 35 U.S.C. §119, to any foreign patent application, which would be incorporated by reference herein. This application is not a Divisional Application of, under 35 U.S.C. §121, and claims no priority under 35 U.S.C. §121, to a U.S. Non-Provisional Application.

COPYRIGHT RESERVATION NOTICE

A portion of the present disclosure and drawings of this patent document and appendices contain material that is subject to copyright protection. The copyright owner has no objection to the facsimile reproduction by anyone of this patent document or the patent disclosure, as it appears in the patent and trademark office patent files or records, but otherwise reserves all copyrights whatsoever.

BACKGROUND OF THE INVENTION

1. Field of the Invention

The present invention relates to small boats and more particularly to outrigger stabilizers for a kayak or canoe.

2. Background of the Invention

Canoes and the covered version known as kayaks have been known for hundreds of years. The first canoes were made from wood and animal skins. Kayaks were great for hunting in cold arctic waters. They were highly maneuverable and allowed their users to catch seals and walruses. Eventually, seal bladders were added to make them nearly unsinkable and hunting expeditions could last much longer if the kayak were fully provisioned.

Unfortunately, the very maneuverability of the kayak was also a weakness due to its instability. In the related art, it is well known that canoes or kayaks and other small watercraft are easily upset by sudden movement of an occupant or rough water in which waves hit against the boat side and can potentially tilt it over in an upsetting fashion. To counter the instability, it is known to attach outriggers as was common in Hawaii. While this improves stability, it greatly reduces the maneuverability so highly prized among kayak operators.

There is a need for a kayak type boat that maintains maneuverability yet is stable. Additionally, it is known that it requires many hours of practice to become an experienced boatman in a canoe or kayak.

DESCRIPTION OF THE RELATED ART

Examples of related art similar to the present invention are described below, and the supported teachings of each reference are incorporated by reference herein:

U.S. Patent Application No. 2002/0069808: KAYAK OR CANOE OUTRIGGER STABILIZER, published Jun. 13, 2002 to HESSE, KENT D, discloses a small boat stabilizer is formed by a pair of elongated tubular buoys secured in laterally spaced parallel relation to respective end portions of the boat by spars extending transversely of respective ends of the boat and secured thereto by adapters.

U.S. Patent Application No. 2007/0068436: WATERCRAFT STABILIZER, published Mar. 29, 2007 to PAGE, discloses a watercraft stabilizer assembly includes a frame comprising a plurality of frame members connected together and a plurality of floats received on the frame. At least one clamp secures the frame to a watercraft. The clamp comprises clamp members that are securable together such that the frame and a portion of the watercraft are held together between the clamp members.

U.S. Patent Application No. 2006/0102063: ACCESSORY PLATFORM ASSEMBLY FOR A KAYAK, published May 18, 2006 to BOELRYK, discloses an accessory platform assembly for attachment to kayak. The assembly comprises attachment means for attaching the assembly to the deck of a kayak, a frame attached to the attachment means, the frame holding a platform and allowing the platform to be moved from a closed position to an open position whereby in the open position the deck of the kayak lying below the platform in the closed position is exposed. The assembly optionally includes an outrigger assembly comprising parallel arms attached at one end to the attachment means and having an outrigger floatation device attached to an opposite end of the arms spaced away from the kayak to provide increased stability to the kayak.

The inventions heretofore known suffer from a number of disadvantages. There does not exist a device or system that is retractably designed to first retain a user in an upright position to different levels of tipping, and to second be retractably stored in a non-deployable position. The present invention, outlined with the accompanying figures, provides a device and apparatus that allows a kayak user to set different levels of tipability during operation and to have a storing retracted position.

What is needed is a retractable stabilization system for kayaks that solves one or more of the problems described herein and/or one or more problems that may come to the attention of one skilled in the art upon becoming familiar with the following specification and drawings about the illustrated embodiment(s).

SUMMARY OF THE INVENTION

The present invention has been developed in response to the present state of the art, and in particular, in response to the problems and needs in the art that have not yet been fully solved by currently available stabilizers. Accordingly, the present invention is a retractable stabilizer for watercraft. It comprises a frame that is secured to a kayak, canoe or other watercraft. The frame rotatably supports a rotating support rod that has a stabilizer attached to it. The stabilizer is rotated into a stabilizing position that greatly increases the stability of the kayak. The stabilizer can also be retracted to enable normal operation of the kayak. In one embodiment, a forward and rear stabilizer is utilized to provide greater stability for longer kayaks including two person embodiments. The present invention was developed to provide stability for a kayak, canoe or other watercraft, specifically to help a novice operator learn how to maneuver the vessel in a multiplicity of water conditions or circumstances by making the vessel less likely to tilt or capsize.

In another embodiment there is a user floatation system for boating safety. There is included in the system a boat, having a seat for a user, and a rear and forward section located behind and in front of the user respectively. There is also a flotation system, including float device, designed to be placed in the water on at least one side of the boat; and frame system, coupled to the boat at one end and to the float device at an opposite end, designed to hold the float device in a 1) deployed position where the float device is held in the water when a user is in the seat, and 2) partially deployed position where the float device is held a distance above the water level when a user is in the seat sufficient to enable the user to tip the boat a certain angle from a level position but to assist in preventing the boat from tipping completely over.

Yet, a further embodiment includes a user floatation system wherein the frame system has a stored position where the float device is held above the water a sufficient distance to allow the boat to tip completely over.

Additionally, another feature embodiment is where the frame system includes an extension portion, coupled between the boat and the float device, designed to enable a user to position the float device in a close and distant position relative to the user while in the seat; and an extension portion locking device, designed to releasably lock the extension portion in both the close and distant position while the user is in the seat.

Moreover, an additional embodiment is where the user floatation system is designed so that the boat is a kayak.

Additionally, the user floatation system embodiment may included the frame system to include a float device rotational coupling device, coupled between the frame system and the float device, designed to rotationally coupled the float device to the frame system, and to enable the float device to rotate about a longitudinal axis that is independent to the rotation of the boat along a boat longitudinal axis.

An additional embodiment may include a feature where the stored position of the frame system enables the float device to be held on top of the rear portion of the boat.

Other features may be where the stored position of the frame system enables the float device to be held in a position located on top of the forward portion of the boat.

Other features and advantages of the instant invention will become apparent from the following description of the invention which refers to the accompanying drawings.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawings. It is noted that the drawings of the invention are not to scale. The drawings are mere schematics representations, not intended to portray specific parameters of the invention. Understanding that these drawings depict only typical embodiments of the invention and are not, therefore, to be considered to be limiting its scope, the invention will be described and explained with additional specificity and detail through the use of the accompanying drawings, in which.

DETAILED DESCRIPTION OF THE INVENTION

Figure 1:
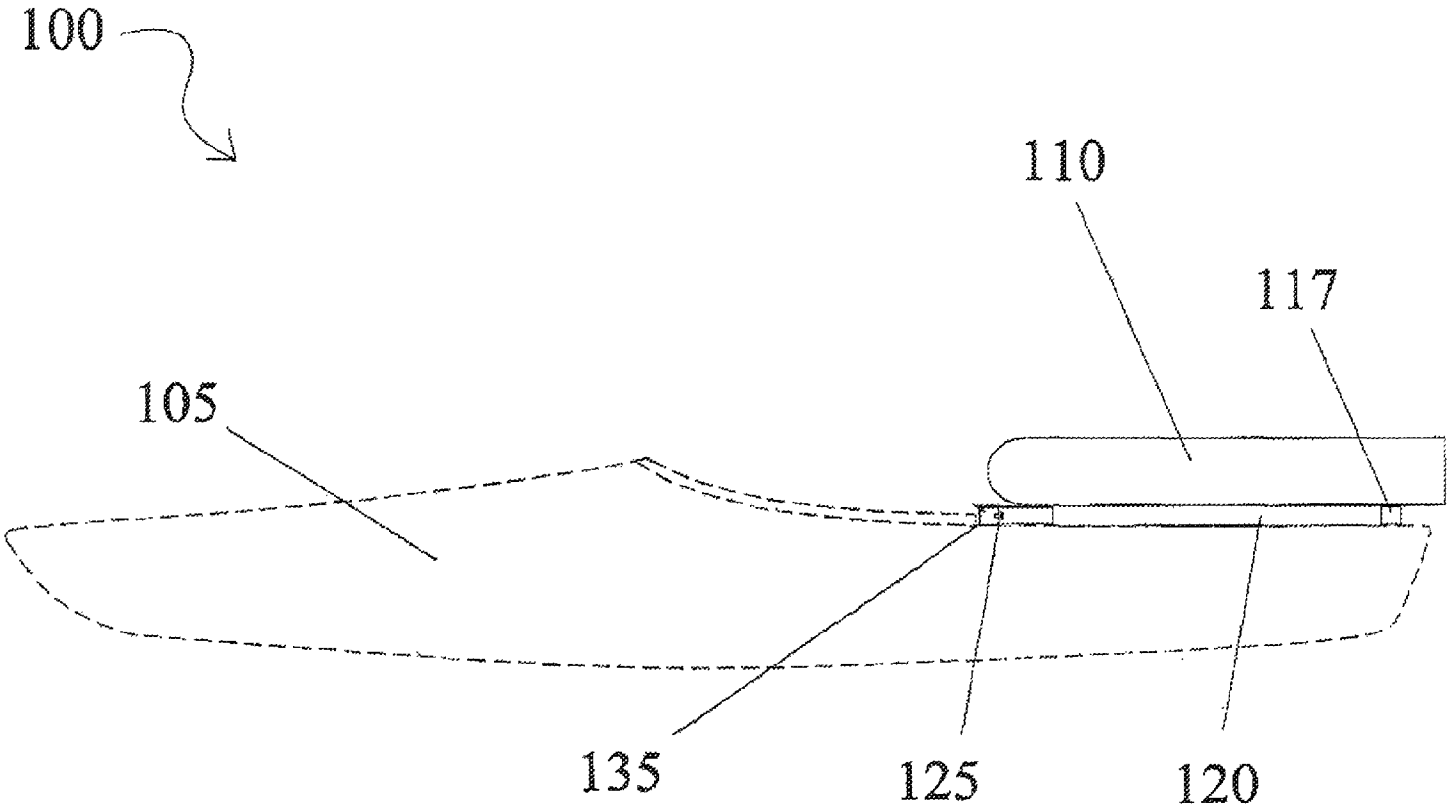
FIG. 1 is a side view of a kayak equipped with a retractable stabilizer according to an embodiment of the presently illustrated invention.
Figure 2:
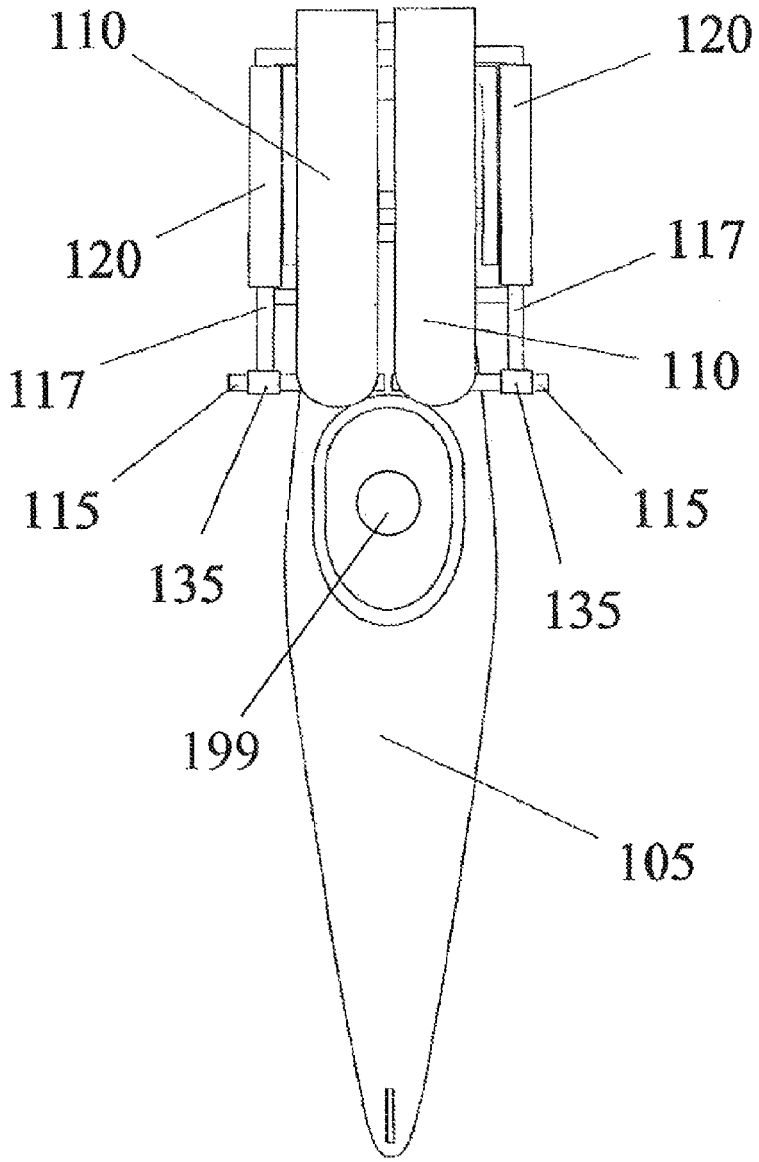
FIG. 2 is a top view of the kayak with a retractable stabilizer illustrated in FIG. 1.
Figure 3:
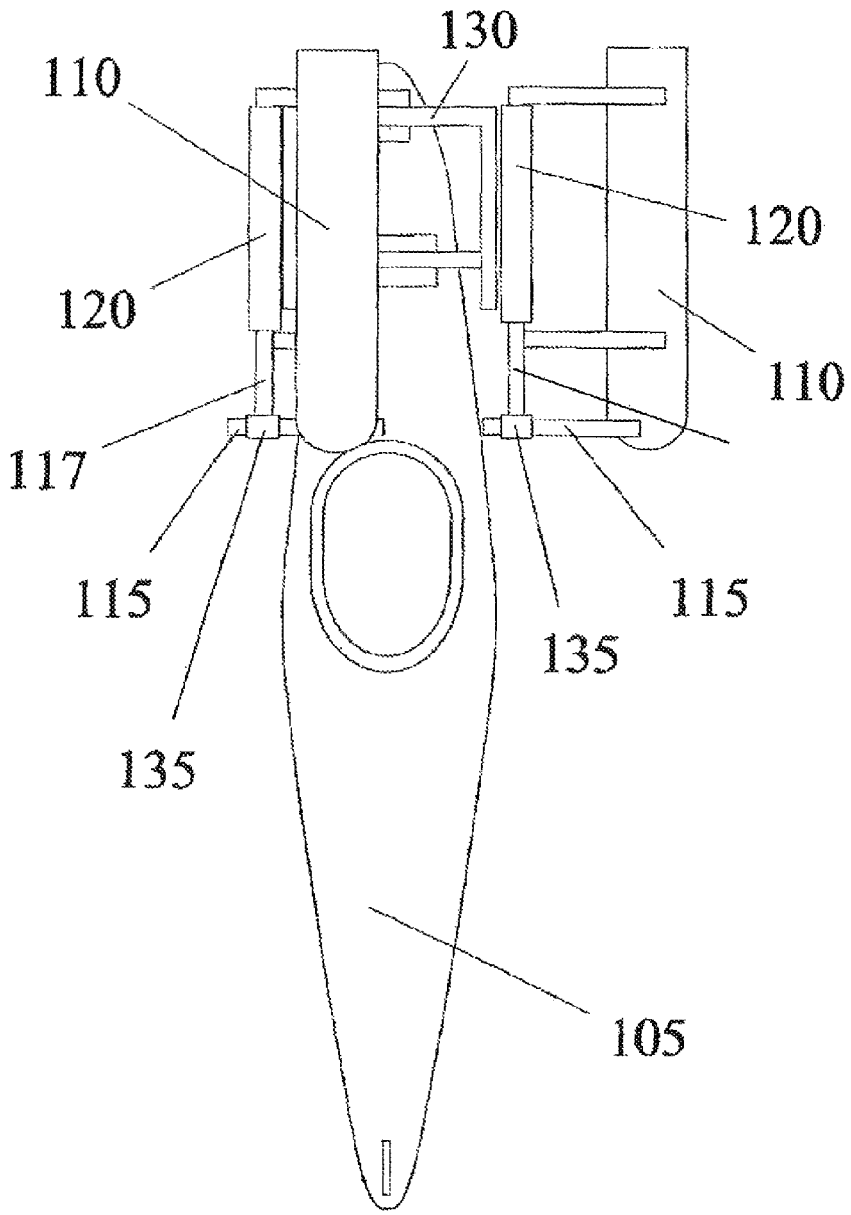
FIG. 3 is a top view of the kayak with retractable stabilizer having one stabilizer in an engaged position.
Figure 4:
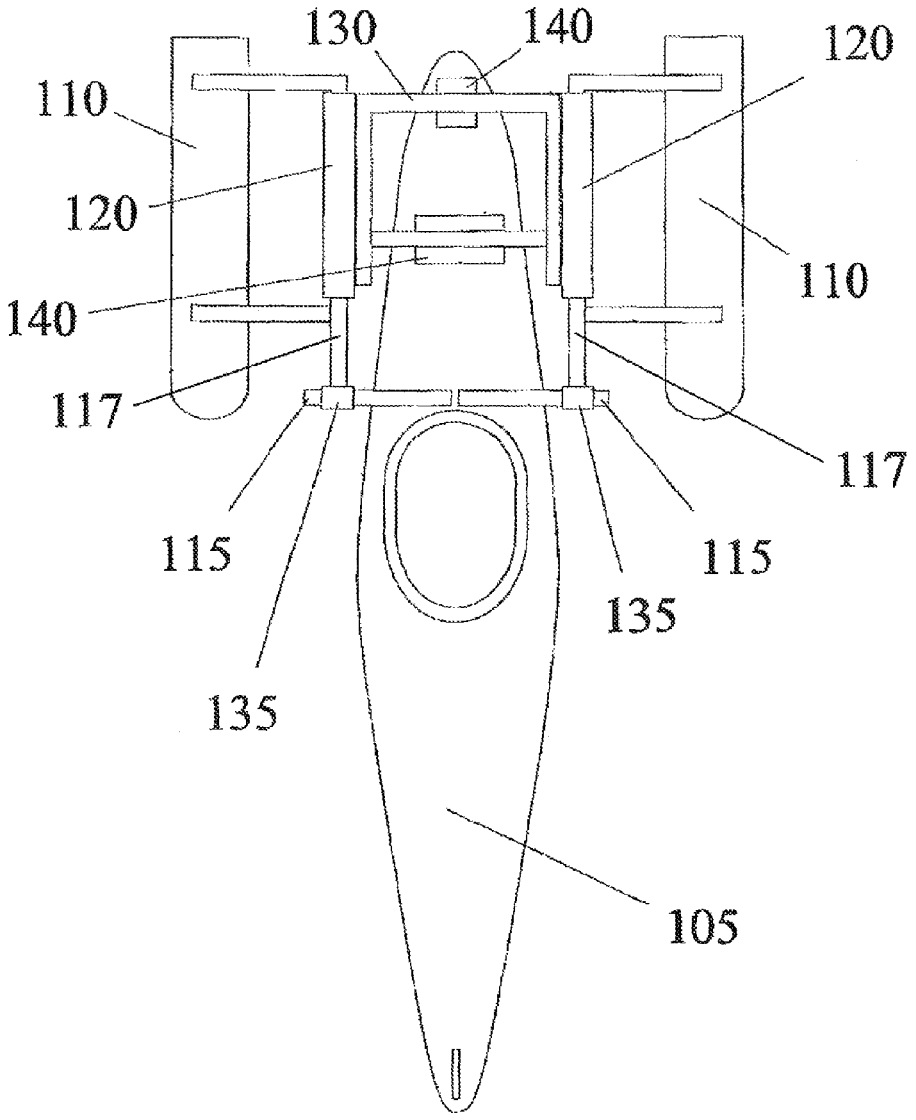
FIG. 4 is a top view of the kayak with retractable stabilizer having both stabilizers in an engaged position.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

As used herein, "and," and grammatical equivalents thereof is intended to be inclusive or open-ended that does not mean that all of the elements in the list must be included. Specifically, the term "and" can be viewed as an equivalent of the commonly used phrase "and/or", which is intended to create an unrestricted list of elements that may or may not require all of the elements to be included therein.

In the following detailed description of the invention, reference is made to the drawings in which reference numerals refer to like elements, and which are intended to show by way of illustration specific embodiments in which the invention may be practiced. It is understood that other embodiments may be utilized and that structural changes may be made without departing from the scope and spirit of the invention.

It is noted that reference is made to the particular wording of a "stabilizer" throughout the specification. This wording refers to a pontoon-like floatation device that is buoyant in water.

It is noted, because the rotatable stabilizer system is symmetric, only one side will be described in detail, and it is understood that there are at least two stabilizers that are identically designed.

DETAILED DESCRIPTION OF THE FIGURES

Referring now to the FIGS. 1 through 4, there is one embodiment of the illustrated embodiment that includes a rotatable stabilizer 110 that is shown attached to a kayak 105 with a stabilizer frame 130. The stabilizer frame 130 may be mounted to attachment blocks 140, which are attached to the kayak 105 using bolts or other suitable mounting systems such as rivets or screws. There is a stabilizer frame 130 that may have a pivot sleeve 120 attached to rotatably hold a rotating support assembly 117 (illustrated as a rod therein). Rotating support assembly 117 has a sliding support arm sleeve 135 attached to an end, to slidably support a sliding support arm 115. A stabilizer 110 is attached to the distal end of rotating support assembly 117 to rotate in place as needed.

Starting, in one embodiment, with the stabilizers 110 in a folded or stored position located on top of the kayak, a user may rotates the stabilizers 110 outward so that the stabilizer 110 is positioned over the edge of the kayak 105. Next, the sliding support arm 115 may be moved back towards the kayak 105. In this configuration, as the stabilizer 110 is pushed upward by water pressure, sliding support arm 115 prevents it from rotating, thus stabilizing the kayak 105.

To retract the stabilizers 110, in one embodiment, the process is reversed. The sliding support arms 115 are moved outward and then the stabilizers 110 are rotated to a refracted position. The length of the sliding support arm 115 may be varied to match a selected kayak or canoe. Additionally, a tie down such as hook and loop tie-down may be used (not shown) to secure the stabilizer 110 from moving while transporting the kayak 105. There is seat 199 that may be relatively flat and horizontal to the bottom of the boat as is well known in the art of boat making, and especially kayak construction.

Figure 5:
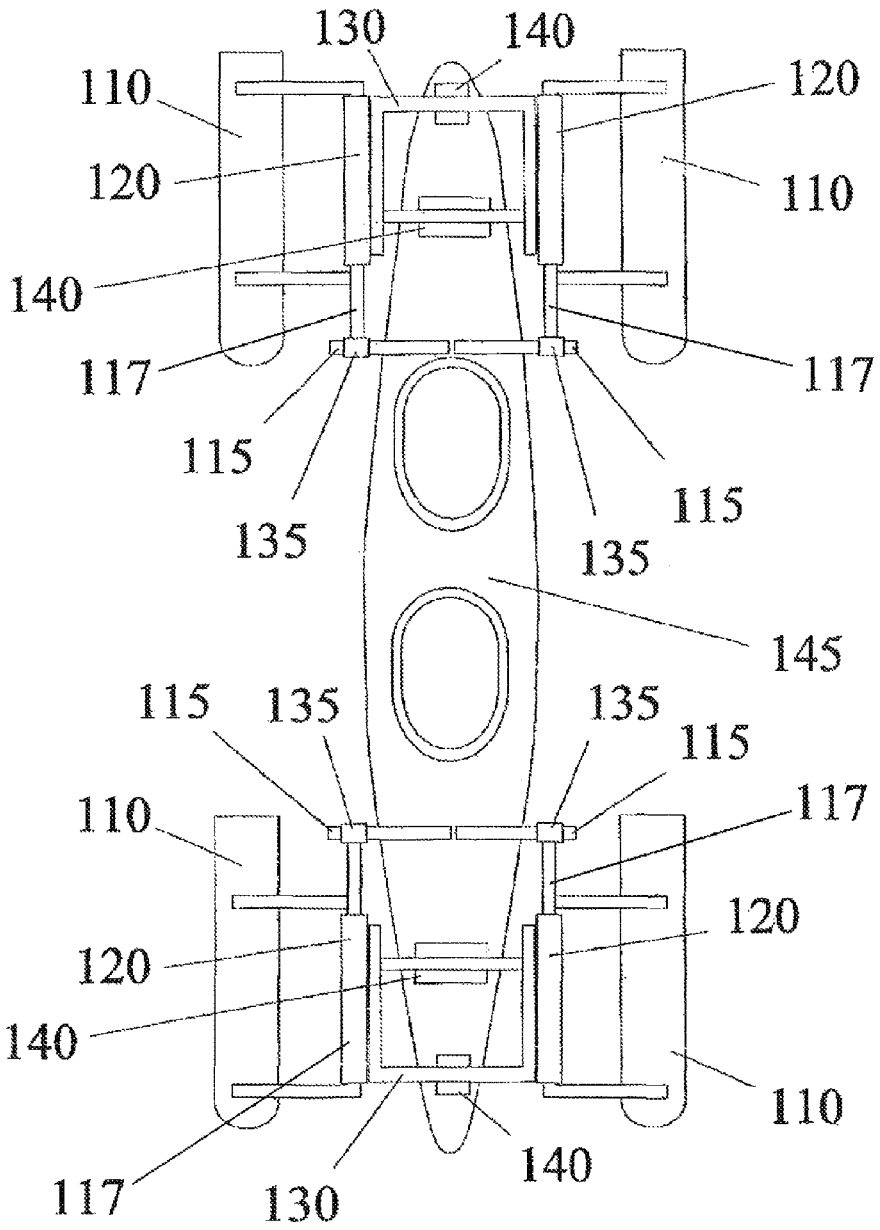
FIG. 5 is a top view of a double kayak with duel retractable stabilizers shown in an engaged deployed position.

Referring now to FIG. 5, a two person kayak 145 is shown having a rear stabilizer and a forward stabilizer attached. Operation is the same as discussed above. A person in the rear operates the rear stabilizer and the front person operates the front.

Optionally, it is possible to place one stabilizing unit in the front of a kayak (not shown) instead of in the rear as shown. Another option not shown is a single rotating support rod that connects the rear and front stabilizers so an appropriately equipped one person kayak may have a front and rear stabilizer that is operable by one person.

The stabilizer may be made of most any known material, like plastic, carbon fiber of other appropriate material. The frame may also be constructed of most any known material, like aluminum or other appropriate material such as PVC pipe.

Although the present invention has been described in relation to particular embodiments thereof, many other variations and modifications and other uses will become apparent to those skilled in the art.

In another embodiment of the invention, starting with the stabilizers 110 in a folded or top position, a user rotates the stabilizers 110 outward so that the stabilizer 110 is positioned over the edge of the kayak 105. Next, the stabilizers are locked into their extended support position over the edge of the kayak 105, as detailed in the FIGS. 6 through 11. In this embodiment, it is intended that the positioning and locking of the stabilizer is done prior to launching the vessel in the water. Because the rotatable stabilizer 110 is symmetric, again, only one side will be described in detail with the understanding that there are at least two stabilizers, one stabilizer per side of the vessel.

Figure 7:
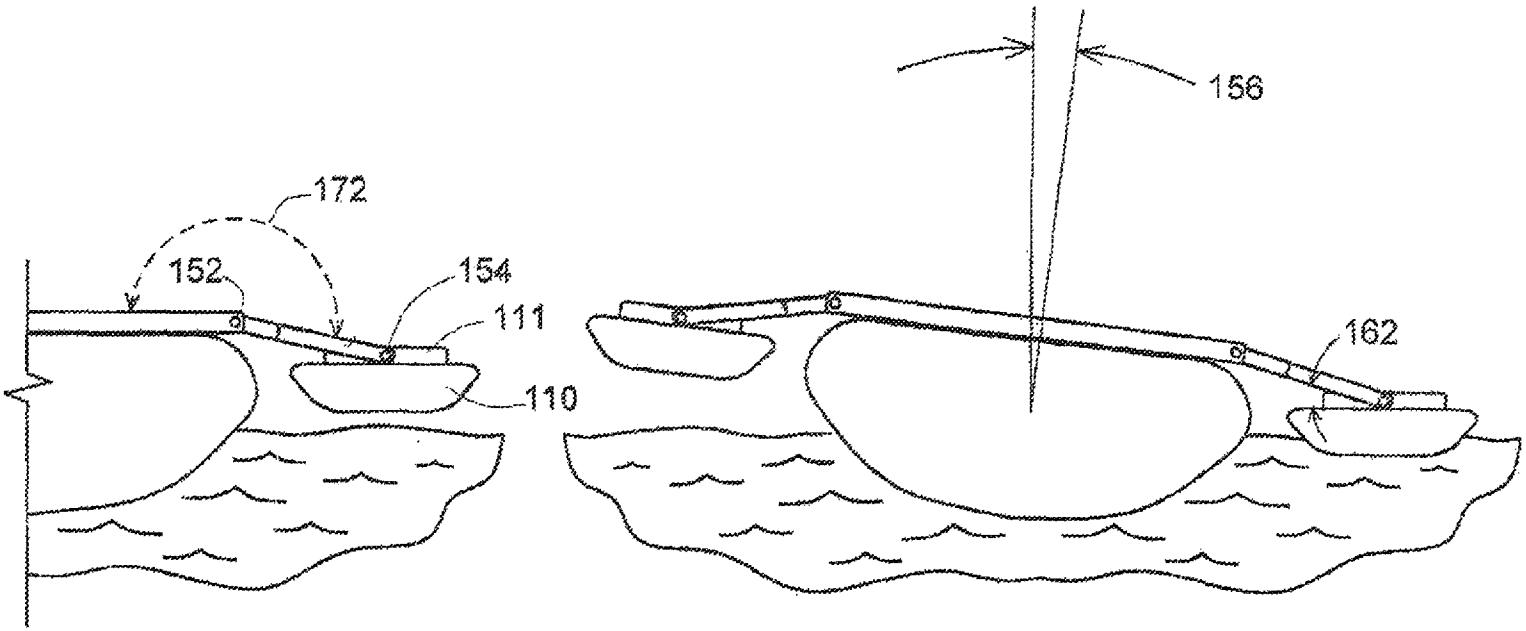
FIG. 7 is a front view of the kayak with the retractable stabilizers, having both stabilizers locked in a slightly lower horizontal position.
Figure 8:
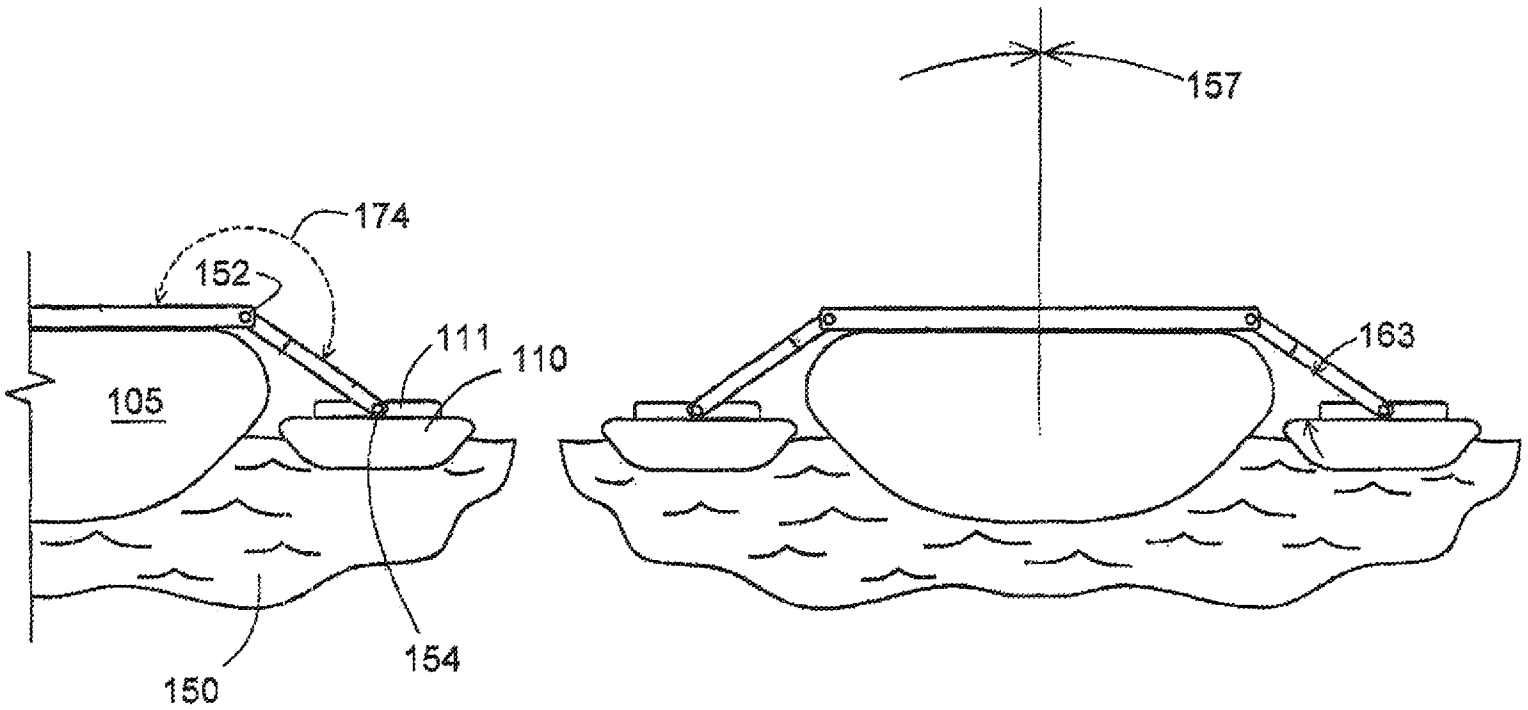
FIG. 8 is a front view of the kayak with the retractable stabilizers, having both stabilizers locked in a lower position, wherein stabilizers are in contact with the water.
Figure 9:
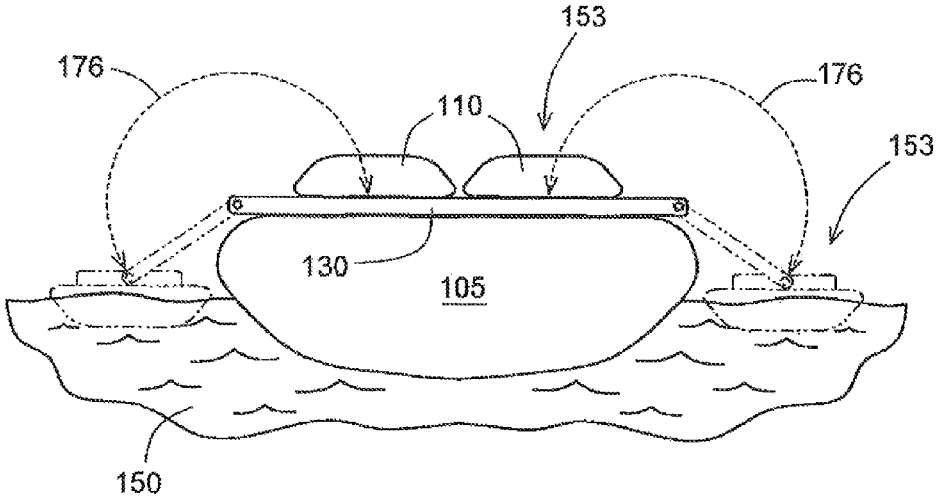
FIG. 9 is a front view of the kayak with the retractable stabilizers, having both stabilizers in the top folded or stored position.

FIGS. 6, 7, 8 and 9 illustrate one embodiment where there are three different locked positions where the stabilizer 110 is position outside of the kayak 105. It would be understood by one skilled in the art that although the figures describe three extended stabilizer positions, and one retracted stabilizer position, where the stabilizer is in its folded or top position as shown in FIG. 9, these four positions that are described are only representative of one or several stabilizer positions.

Figure 6:
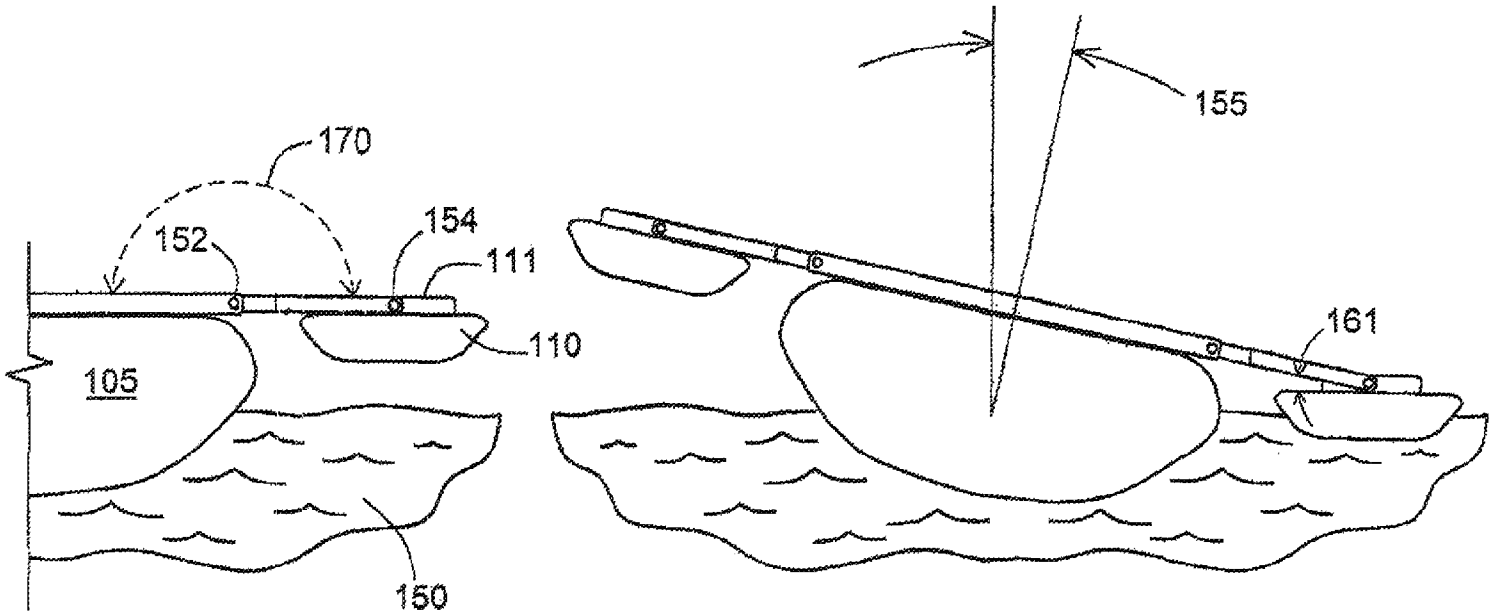
FIG. 6 is a front view of the kayak with the retractable stabilizers, having both stabilizers locked in a horizontal position.

In FIG. 6, there is one embodiment that illustrates that the stabilizer 110 may be rotated from the top position, as shown in FIG. 9, through an angle of approximately 180 degrees, indicated by the dotted arrow 170, to an essentially horizontal locked position.

In FIG. 7, in one embodiment, the stabilizer 110 is rotated from the top position through an angle of approximately 195 degrees, as indicated by the dotted arrow 172, to a lower than horizontal locked position.

In FIG. 8, the stabilizer 110, in one embodiment, is rotated from the top position through an angle of approximately 120 degrees, as indicated by the dotted arrow 174, to a much lower than horizontal locked position. The precise angle of rotation, of the stabilizer, from the top position into the extended positions is not critical. These figures merely illustrate that the stabilizers can be rotated from a top position and subsequently locked in a number of different rotatable extended positions.

FIG. 9 is a front view of the kayak 105, which is resting in the water 150, in one embodiment. The frame 130 is mounted to the top shroud of the kayak 105. In this figure, the stabilizers 110 have been rotated from their fully extended or deployed position, through an angle shown by the dashed arrow element 176, to their top position 155.

Figure 10:
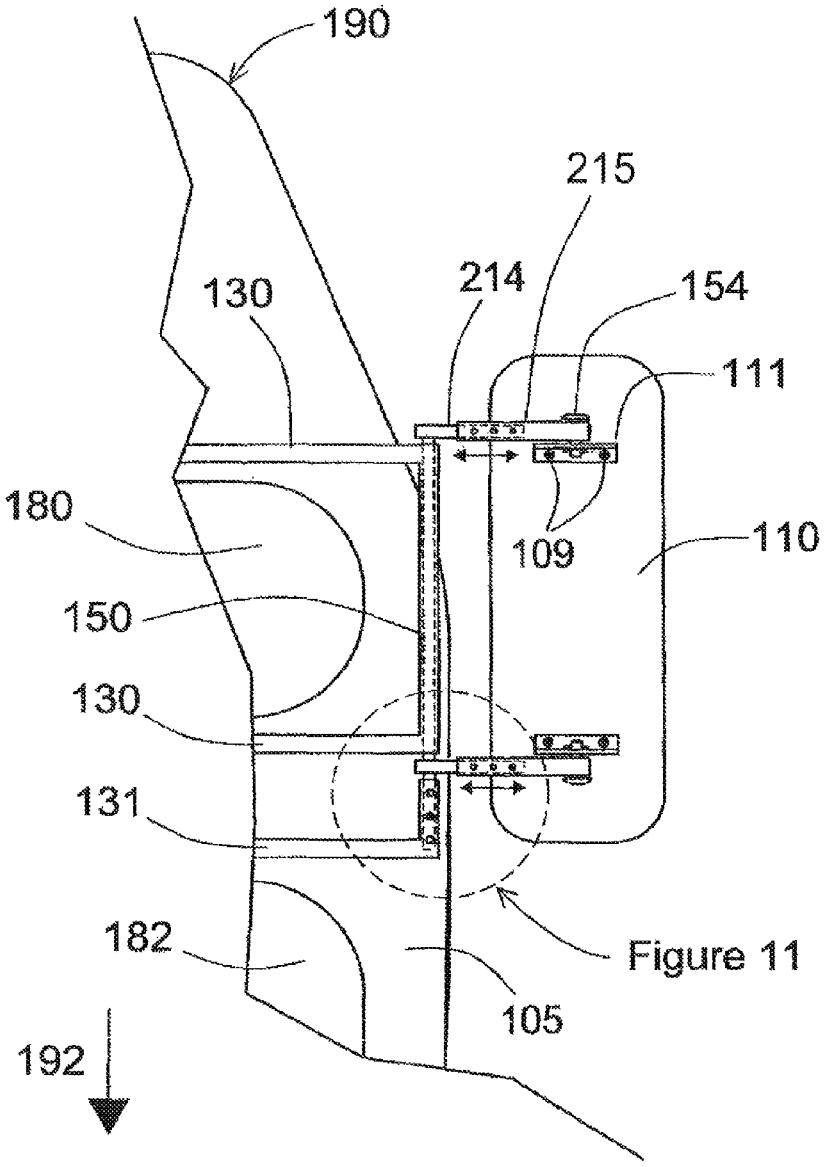
FIG. 10 is a top view of the kayak with the retractable stabilizers in the horizontal position.

FIG. 10, is a top view of the kayak 105, in one embodiment. The front of the kayak is indicated by the directional arrow 192 and the rear of the kayak is indicated by the element 190.

This figure provides detail as to the positioning of the frame 130 on the kayak 105. The frame 130 is configured such that it can be attached to the kayak and the construction therein does not interfere with the seat 182, or the storage compartment 180.

Also shown in FIG. 10, in one embodiment, there is illustrated the stabilizer 110, which is positioned in a horizontal extended position, as characterized in FIG. 6. As shown in FIG. 10, the stabilizer 110 is ridgedly attached to the mounting brackets 111 using bolts or other suitable mounting devices such as rivets or screws 109. At least two mounting brackets 111 are mounted to each stabilizer, in one embodiment. Optionally, the mounting brackets 111 could be integral with the stabilizer 110 or adhesively attached or welded to the stabilizer 110. The mounting brackets 111 are pivotably connected to the stabilizer support arm 215 by means of a connector pin 154. This pivotable connection allows the stabilizer 110 to pivot about the connector pin 154. The pivoting motion of the stabilizer 110 enables the stabilizer to remain parallel to the surface of the water 150.

Figure 11:
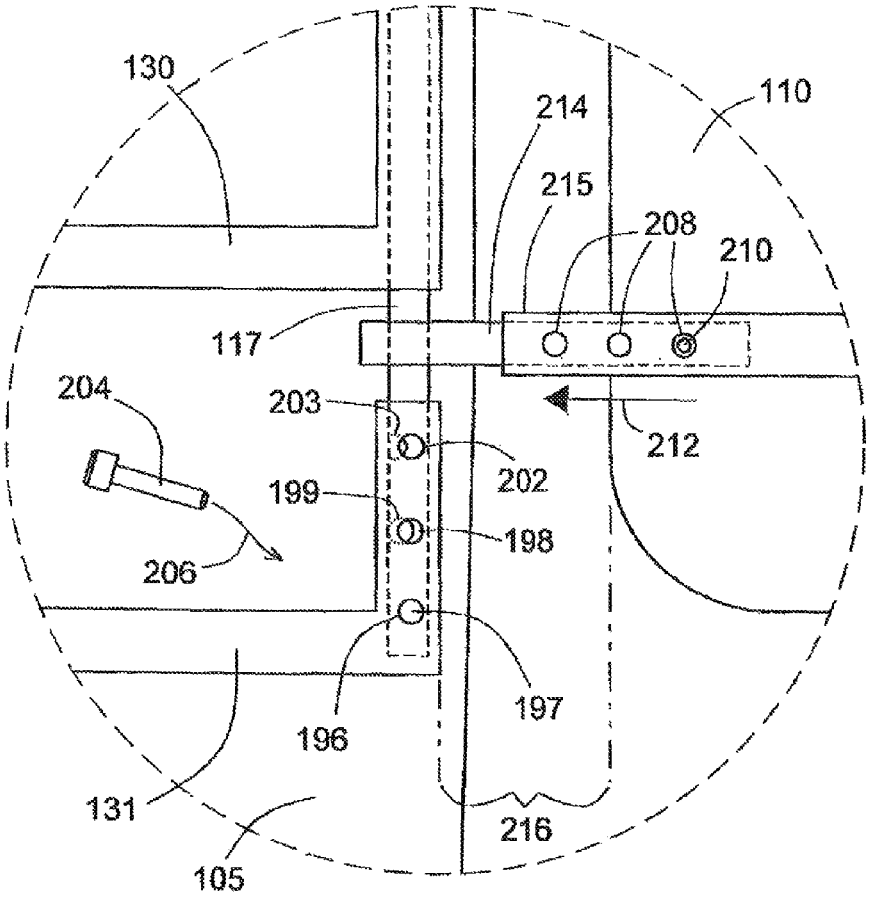
FIG. 11 is a top view of the stabilizer position locking mechanism, and the stabilizer extension device.

FIG. 11 provides details for one embodiment of the stabilizer extension device. The stabilizer 110 is connected to the stabilizer support arm 215 (connection not shown in FIG. 11). In this embodiment the stabilizer support arm 215 is a tubular structure which is slidably connected to the arm base 214. The arm base 214 can slide into the stabilizer support arm 215 as indicated by the arrow 212. This sliding motion 212 allows one to increase or decrease the distance the between the stabilizer 110, and the side of the kayak 105. As the distance 216 is increased, the stability of the kayak may also increases.

A series of extension adjustment holes 208 are located on the end of the stabilizer support arm 215. In this embodiment of the invention, a detent style fastener is fixedly attached to the end of the arm base 214. The relative position of the stabilizer support arm 215 and the arm base 214 becomes locked when the detent fastener 210 synchronizes with an extension adjustment hole 208. The distance 216 can be adjusted by depressing the detent fastener 210 and sliding 212 the stabilizer support arm 215 to a new position and allowing the detent fastener to synchronize and lock with another extension adjustment hole 208. In this embodiment a detent fastener is used to lock the stabilizer support arm 215 and the arm base 214; however, it is anticipated that any number of fastening devices or suitable locking means, including but not limited to bolts, rivets, pins, screws, collets, clamps and clips, could be used to securely lock the stabilizer support arm to the arm base.

The arm base 214 is rigidly attached to the rotating support 117, such that a change in the height of the stabilizer creates an angular movement of the arm base 214, which in turn rotates the rotating support 117.

Also illustrated in FIG. 11 is the stabilizer position locking mechanism. In this embodiment of the invention, the rotating support 117 is sleeved by the non-rotating stabilizer frame 130. This sleeve allows the rotating support 117 to independently rotate within the stabilizer frame 130. The stabilizer frame 130 is rigidly mounted to attachment blocks 140 which are rigidly attached to the kayak 105 using bolts or other suitable mounting devices such as rivets or screws. The stabilizer frame 130, in one embodiment may be made of a tubular construction.

The stabilizer position locking mechanism is provided by a locking frame member 131. The locking frame member 131 may be tubular in construction, and would be rigidly attached to the kayak 105 using, for example, bolts or other suitable devices for securing it to the kayak 105. The distal end of the locking frame member 131, which sleeves and supports the rotating support 117 may have a series of frame positioning holes 197, 198 and 202. Corresponding positioning holes 196, 199, 203 are located in the rotating support 117. FIG. 11 shows a frame positioning hole 197 in alignment with a matching positioning hole 196. In this position, the stabilizer 110 is in the essentially horizontal position, as illustrated in FIG. 6.

If the stabilizer 110 is lowered, which in turn rotates the rotating support 117, it brings the frame positioning hole 198 in alignment with the matching positioning hole 199. In this arrangement, the stabilizer 110 is in the lower than horizontal position, as illustrated in FIG. 7.

If the stabilizer 110, on the other hand, is lowered to an alternative arrangement, shown in FIG. 8, the frame positioning hole 202 would be in alignment with the matching positioning hole 203.

In this embodiment of the invention, the locking mechanism is illustrated as a bolt 204, which is placed in the two matching holes. In FIG. 11, the bolt 204 would be inserted in and securely fastened to the corresponding holes 197 and 196 by means of screwing or bolting in place with a nut. Because the locking frame member 131 is rigidly attached to the kayak 105, the rotating support 117 is restricted from any rotation, until such time that the bolt 204 is removed.

It is noted, the stabilizer extension device is used to position the stabilizer 110 further away or closer to the side of the kayak 105 or vessel. However, in another embodiment, the illustrated stabilizer extension device could be substituted with a scissor type extension system as illustrated in U.S. Pat. No. 3,350,065, SCISSOR-TYPE LINEAR ACTUATOR WITH HIGH EXTENSION RATIO AND SELECTABLE EXTENSION RATE AND POWER REQUIREMENT, by Harry S. Mankey, issued Oct. 31, 1967. Using a scissor-type extension system would allow the distance 216 between the kayak and the stabilizer to be more dramatically increased than the illustrated embodiment. This means of extension would not be limited to the combined lengths of the arm base 214 and the stabilizer support arm 215 previously described.

METHOD AND OPERATION OF THE INVENTION

In one embodiment, the purpose of the stabilizer assembly is threefold: (1) Provide a stabilizer assembly that can be easily installed/removed on a kayak, canoe or watercraft; (2) Provide adjustable levels of stabilization for a kayak, canoe or other type of watercraft, where the degree of stabilization can be adjusted for the situation and condition of the water; (3) Provide a training help or aid for an operator, learning to maneuver a kayak. This invention would assist the operator much like training wheels help a child learn how to ride a bike.

In another embodiment, when the vessel is being transported, the stabilizers would most likely be rotated to the top position as shown in FIG. 9. When a person is learning how to operate a kayak, the highest level of stability is desirable. Thus, the person would extend the stabilizer to the maximum length and then adjust the stabilizers to the "much lower than horizontal" position, as shown in FIG. 8. The angle of tilt for the craft is essentially limited zero "0" degrees as shown by element 157.

As the operator becomes more familiar with the craft and more adept at operating it in turbulent waters, the stabilizers could be retracted and elevated, as shown in FIG. 7. Thus the angle of tilt for the craft is increased, as shown in element 156. This greater tilt gives the operator a more realistic feel for the craft and for the general operating conditions.

As the skill of the operator becomes greater, the stabilizers can be further retracted and elevated, such as a maximum essentially horizontal position, which is illustrated in FIG. 6. Here the angle of tilt for the craft is increased even more, as shown in element 155. In this position, the operator gets a true or almost realistic feel of the craft; however, in this position, the craft would tilt but it would resist capsizing.

Once the operator become adept in all phases of the craft, the stabilizer assembly could be easily removed, much like removing training wheels from a bike.

There are many advantages that are realized by the retractable stabilizer system of the illustrated embodiments of the invention that are not taught by the known prior art. One skilled in the art will realize the benefits that are afforded the novice or beginning kayaker, or for fisherman that wants to stand in the kayak while fishing.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the reference has been made to kayaks throughout the specification, one skilled in the art will realize after reading the specification in light of the illustrated embodiment, there are other uses for the illustrated embodiments of the invention. Specifically, the same device would be adaptable to other vessels, like canoes, row boats, wave runners, ski boats, fishing boats, etc.

It is further noted that the structural elements of the illustrated embodiments may be made of most any material. For example, the material of the frame may be made of aluminum, fiber glass, plastics, ceramics, wood, etc. Additionally, the material for the stablizers may be made hollow or solid, made of foam, wood, aluminum, plastic, fiber glass, etc.

Although the frame of the illustrated embodiment is illustrated to have a certain number of parts and shapes, any number of parts and shapes is considered to be within the scope of the presently illustrated embodiments. For example, sheets of material could be used instead of tubes. Any number of tubes could be used for increased supports.

Moreover, although the floats are illustrated to stored above the surface level of the kayak, one skilled in the art could easily modify the illustrated embodiment. For example, the floats could be positioned below the top surface of the kayak by having recessed cavities built within the top of the kayak.

Another modification to the illustrated embodiment includes forming the entire structure integral with the kayak. For example, key features of the frame could be molded into the kayak. Wherein, the parts located on top of the kayak could be molded into the walls or be internally portioned inside the kayak. The tubes or sheets of material could also be more conformal to the kayak or boat.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

The invention claimed is:

1. A user floatation system, comprising:

a) a kayak, having a relatively flat surface seat with a first horizontal orientation for a user to sit thereon, and a rear and a forward section, each enclosed by a top kayak surface, and each located behind and in front of the seat respectively; and b) a float device, designed to be placed in the water on at least one side of the boat, having: flat top side, and a convex bottom side that is opposite and attached to the flat top side;

c) a frame system, having a rotating support assembly that is rotatively coupled to the kayak at one end, and rotatively coupled to the flat top side of the float device at an opposite end, and having a first position, enabling the flat top side of the float device to rotate sufficiently to be parallel to the first horizontal orientation of the seat, and having a second position, positioning the flat top side of the float device to form an angle with the first horizontal orientation of the seat;

d) wherein the frame system is designed to hold the float device in a 1) deployed position, where the float device is held in the water when a user is in the seat, and 2) partially deployed position, where the float device is held a distance above the water level when a user is in the seat sufficient to enable the user to tip the boat a certain angle from a level position but to assist in preventing the boat from tipping completely over;

e) wherein the frame system has a stored position, where the rotating support assembly is rotated to invert the position of the flat side of the float device to be juxtaposed and relatively parallel to the top kayak surface;

f) wherein the frame system has an extension portion, coupled between the rotating support assembly and the float device, designed to enable a user to position the float device in a first close and then a second distant position relative to a user while seated in the seat;

g) wherein the frame system has an extension portion locking device, designed to releasably lock the extension portion in both the close and the distant position; and h) wherein the frame system further has a pivotable connection, coupled between the frame system and the float device, designed to pivotally couple the float device to the frame system, and to enable the float device to rotate about a longitudinal axis that is independent to the rotation of the kayak along a kayak longitudinal axis.

* * * * *